United States Patent [19]

Mazer

[11] Patent Number: 4,934,704

[45] Date of Patent: Jun. 19, 1990

[54] INDOOR GOLF COURSE

[76] Inventor: William Mazer, 12711 E. Jefferson, Detroit, Mich. 48224

[21] Appl. No.: 345,459

[22] Filed: May 1, 1989

[51] Int. Cl.[5] ..... A63B 69/36; A63B 67/02

[52] U.S. Cl. ..... 273/176 F; 273/176 J; 273/177 R; 273/176 L

[58] Field of Search ..... 273/176 L, 176 F, 176 FB, 273/176 FA, 178 R, 87 R, 87 B, 87 C, 87 D, 277, 259, 245, 176 R, 176 A, 176 AB, 176 D, 176 E, 176 G, 176 J, 177 R

[56] References Cited

U.S. PATENT DOCUMENTS

| | | | |
|---|---|---|---|
| 1,338,963 | 5/1920 | Rolfe | 273/176 F |
| 1,470,117 | 10/1923 | MacRae | 273/176 L |
| 3,027,163 | 3/1962 | Saatzer | 273/178 R |
| 3,584,877 | 6/1971 | Florian | 273/176 FB |
| 4,294,450 | 10/1981 | Gallic | 273/176 J |

*Primary Examiner*—George J. Marlo

[57] ABSTRACT

An indoor golf game consisting of nine holes of play on a carpet or carpet like substance which is divided into two playing fields having point zones and on which each player, using a golf club, propells a golf ball toward the highest designated point zone in order to obtain the highest number of points over the nine hole course.

This specially designed Indoor Golf Course has nine holes of various distances, two fairways, two greens, two targets, rough, several sand traps, a water hazard and a scoring system to numerically evaluate each individual shot.

One feature of the target zone comprising scoring system is the three concentric rings and an egg shaped elongated center to represent the putting cup.

The scoring system utilizes point values regardless of where ones ball comes to rest. Minus two points for a ball hit completely off the carpet course. Minus one point for a ball hit into a sand trap. Zero points for a ball hit anywhere on the course not otherwise indicated by a specific number. One point for a ball hit on to the one point zone which is slightly larger than the entire green. Two points for a ball hit on the green but not on the target. These points for a ball hit on to the red concentric ring. Four points for a ball hit on to the white concentric ring. Five points for a ball hit on to the blue concentric ring. Six points for a ball hit on to the orange egg or circular shaped center.

12 Claims, 2 Drawing Sheets

INDOOR GOLF COURSE

BACKGROUND OF INVENTION—FIELD OF INVENTION

This invention relates to indoor golf courses, specifically those that can be used as playing field gameboards for a variety of golf games using a standard golf ball and putter.

BACKGROUND OF THE INVENTION—DESCRIPTION OF PRIOR ART

This invention is related to the game of golf, and specifically to bringing a realistic, competitive, entertaining, miniaturized golf course indoors. Golf is an outdoor sport that emphasizes skill over strength. Each player uses a club to propel his ball from a tee into a distant hole in the fewest number of strokes possible. It is presumed that the origins of golf began with "Paganica", a game played by the Romans using a curved stick and a piece of leather stuffed with feathers some two thousand years ago.

Today, the game is a twenty billion dollar per year industry and is growing in popularity with no end in sight. Golf is a game that requires practice to consistently improve ones score. Golf is also a game of many different games. Putting is the game within the game of golf that accounts for nearly half of all strokes taken by the average golfer.

However, due to the great expense of building and maintaining outdoor nine hole putting courses there is a lack of adequate putting courses to practice and compete on. Thus, the need for people to play, practice and enjoy golf must take on new forms if we are to foster the games growth and reduce the average golfers score.

One new avenue of development is miniaturized courses for the home or office.

Based upon our search and investigation, the most important distinction between all prior art and the subject game device is that all prior art is based either on roll of the dice boardgames, U.S. Pat. No. 4,277,065 issued July 7, 1981 to William D. White, or based on complex electronically sensitized surfaces such as U.S. Pat. No. 4,017,085 issued Apr. 12, 1977 to Charles Stephen Maxell, or chipping and putting practice mats such as U.S. Pat. No. 4,017,084 issued Apr. 12, 1977 to Ernest Jeffery. This golf mat utilizes a wire "flag accessory device", which is placed on the mat and significantly affects the roll of the ball and thus is an inaccurate gage. However, even if it were an accurate gage it does not evaluate shots numerically, or evaluate shots that finish on the carpet outside of the target. Secondly, it does not incorporate aesthetically pleasing golf holes dyed into the carpet for enhanced realism. Third it does not serve as a colorful throw rug for a den or office.

Our product is completely self contained. It is simply the pattern on the rug that creates the scoring system and golf hole atmosphere which serves as the field of play for the various games to be played.

No other golf games, utlizing a golf club and a ball attempt to reproduce the many elements of a golf hole from an aerial view, or utilize a scoring system to evaluate each individual shot regardless of where the ball comes to rest.

No other golf games are nine hole putting courses with holes of various lengths that allow you to play a round, and shoot a score based on which one of the four games one selects to play. My game device further provides a group of games that can be played by one or more players on a course as compared to a solitary player merely practicing putting strokes on a green mat with a hole in it.

It should be apparent that the preferred embodiment is only one of many possible embodiments and that other embodiments will be apparent to individuals skilled in the field and business of golf. Other obvious embodiments of this invention are any indoor carpet golf course games involving from 1 to 18 tees, greens, fairways, roughs, sand traps, and water hazards to simulate a golf course either outlined or solidly colored on a level loop or cut-pile carpet ranging from very small throw rugs and medium sized area rugs to room size or complete home or club carpet courses that cover many rooms and utilize a numerical and/or alphabetical characters scoring system.

The need for a realistic home play-practice training course for the game of golf has never been greater. Researching prior art we have not found any indoor golf games with a unique and golf-related scoring system to evaluate each individual shot numerically based on where one's ball comes to rest on the course, whether it be on the fairway, in the rough, on the green, on a target or targetted area on the green or possibly in a hazard or out of bounds.

DRAWING FIGURES

DETAILED DESCRIPTION OF THE DRAWING

Figure 1:
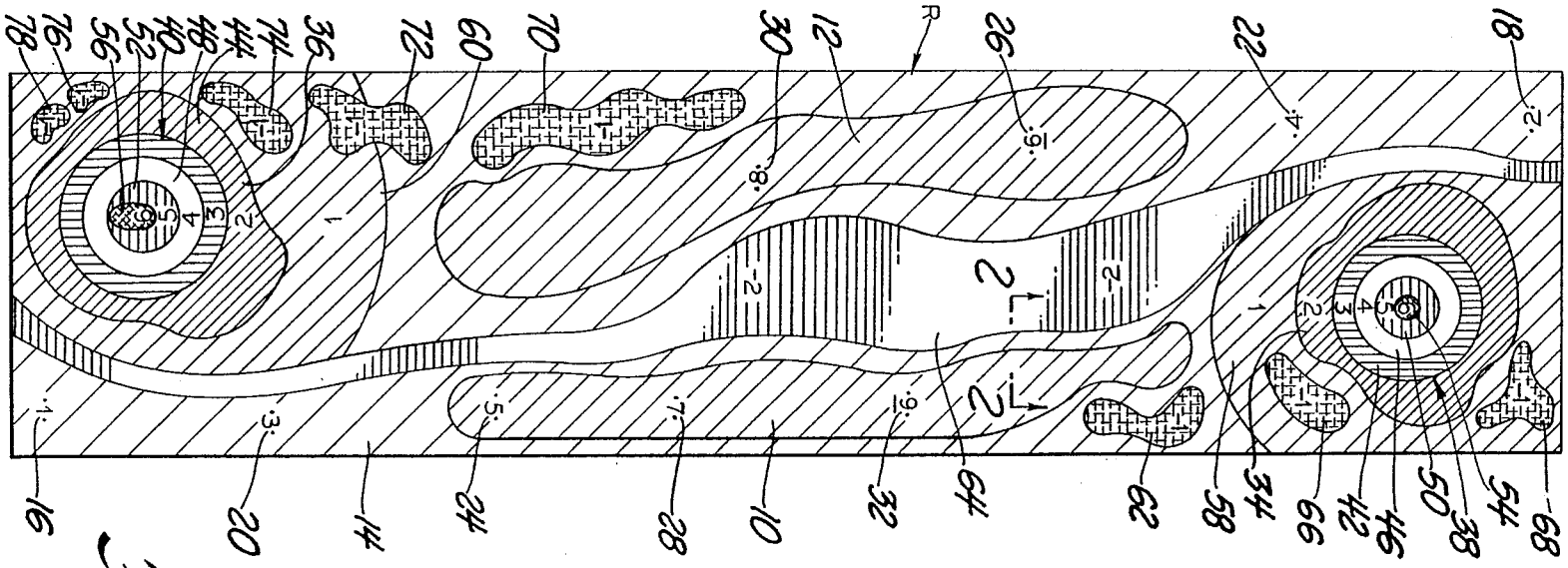
FIG. 1 is a top plan view of a preferred embodiment of the invention.
Figure 2:
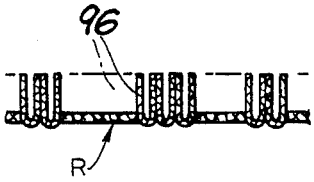
FIG. 2 is an enlarged fragmentary sectional view of the carpet material taken along the line or direction 2—2 of FIG. 1.
Figure 4:
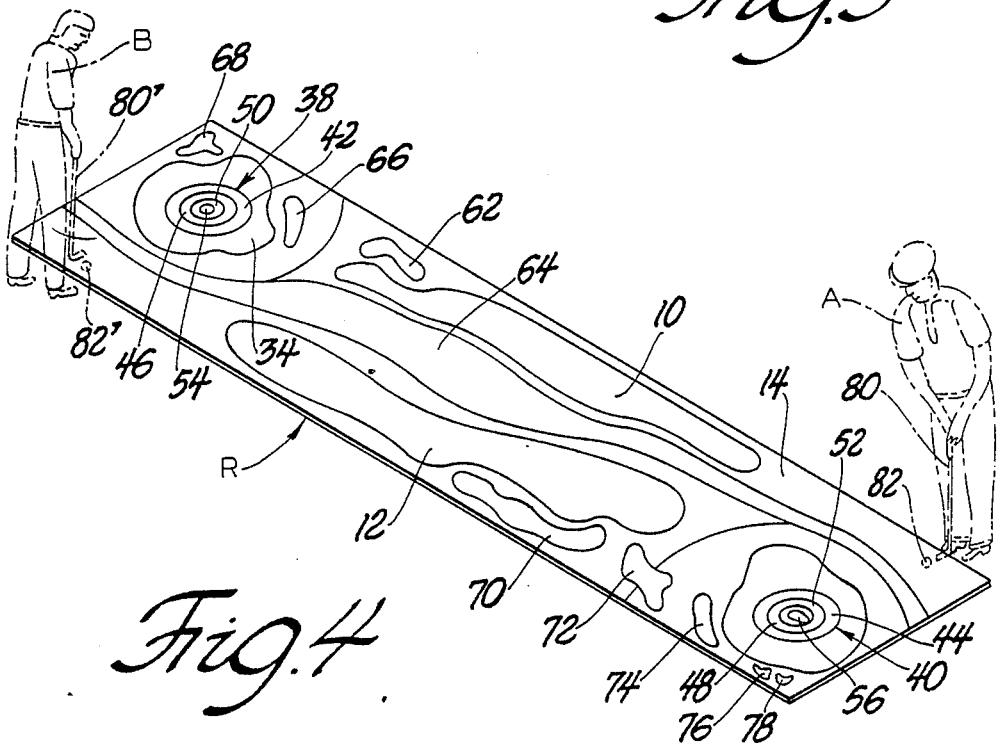
FIG. 4 is a perspective view illustrating features and a manner of use of the golf game device of FIG. 1.

With reference to FIG. 1, there is depicted on an elongated mat or runner R an aerial view of the preferred embodiment for the indoor golf course for the home or office. As can be seen in FIG. 1, there are two golf holes or playing fields, which are divided by a water hazard 64 and are to be played in opposite directions from nine separate tees or playing positions 16–32 to two targets 38 and 40 on the greens 34 and 36 by one or more players A,B (FIG. 4), each using a standard golf club and ball 80 (80') and 82 (82'), which are not part of the claimed invention. The mat or runner R is preferably formed of a cut-pile level loop carpet fiber material 96, as shown in FIG. 2.

Fairways 10 and 12 are surrounded by the rough 14 which contains eight sand traps 62,66,68,70,72,74,76 and 78.

The rules of each of the four games, One-Shot Tournaments, Two-Shot Tournaments, Bump Golf and Create Your Own Hole Competitions are different but generally the object of each game is the same. That is to score as many points as possible by hitting the ball from a designated tee toward the simulated cup 54 and 56 which are the egg or circular shaped centers of the target areas 38 and 40 on the carpet course.

Figure 3:
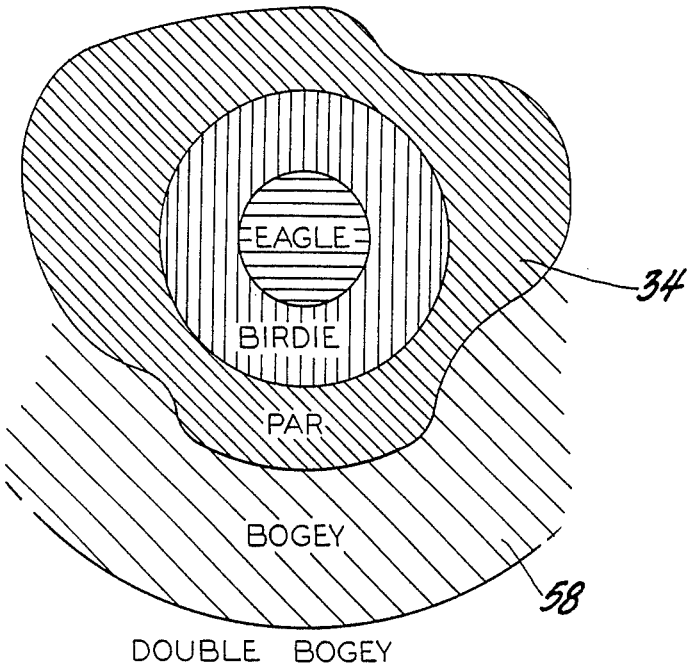
FIG. 3 is an enlarged fragmentary view of an alternative form of target area of FIGS. 1 and 4 having alphabetical character scoring zone designations thereon.

The scoring system utilized is composed of designated point zones as follows: out of bounds is designated to be minus two points for any ball hit off the golf course carpet surface, a water hazard 64 is to be minus two points, a sand trap hazard 62 is to be minus one point, all areas not otherwise marked are zero points. An area that surrounds the entire green encompassing part of the rough and fringe 58 and 60 is the one point zone, the entire green 34 and 36 other than the target areas 38,40 on the green is the two point zone, the red, largest concentric ring 42 and 44 is the three point zone, the white, second largest concentric ring 46 and 48 is the four point zone, the blue, third largest ring 50 and 52 is the five point zone and the elongated egg or circular shape center 56 is the six point zone. The maximum score for a nine hole event using one ball per player is fifty-four points. Instead of, or in addition to, the numerically valued scoring point designations for the target areas depicted in FIGS. 1 and 4, the numerical scoring point zones and surrounding areas thereof can be marked or labelled with one or more alphabetical character value scoring designations as "EAGLE", "BIRDIE", "PAR", "BOGEY", OR "DOUBLE BOGEY", as in FIG. 3, for example. The elongated center of the target 40 is composed of a half circle at the base and an elongated curve at the top, whereby the distance from the farthest and highest point of the elongated curve, to the center of the egg shaped target is twice that of the radius of the half circle, which is the lower half and base of the egg shaped target.

The purpose of the elongated center of the Mazer-Target is to add to the realism of the carpet course. In the game of golf when playing on a standard playing course, a ball hit slightly too hard, on line, in the exact direction of the hole may still go into the cup or hole. Thus, the egg-shaped central area of the target 40 is intended to approximate this playing condition and compensates for the fact that there is no hole in the carpet to get in the way of the ball. Thus, shots hit just beyond the center of the target will still be counted as if they went into the cup and be scored six points thus adding to the realism of the carpet course when comparing play on the carpet course to play on a standard outdoor course.

OBJECTS AND ADVANTAGES

Accordingly, besides the objects and advantages of indoor golf course device described herein, additional objects and advantages of the present invention are:

(a) to provide an practice golf course on a carpet or carpet like substance;

(b) to provide an indoor nine hole practice course on an elongated runner or mat formed of a piece of carpet or carpet like substance;

(c) to provide a indoor golf course with a scoring system in which designated point zones evaluate each individual shot.

(d) to provide a nine hole indoor golf practice course having two fields of play for one or more players and affording four separate games, as games, One Shot Tournaments, Two Shot Tournaments, Bump Golf and Create Your Own Hole Competitions, to be played with a golf club and a golf ball;

(e) to provide a nine hole practice putting course that can also accomodate chipping (f) to provide a nine hole golf course on a mat or runner, which has no accessory devices, attachments, or holes or openings in, on or to the carpet runner and which, when not in use, can be left in place as an attractive throw rug for a recreation room or office.

Further objects and advantages are to provide a elongated egg shaped center for a target to allow for balls hit a bit too hard beyond the center of the simulated golf hole to still be counted as a perfect shot going in the golf hole as would be the case when playing on an outdoor standard playing course.

REFERENCE NUMERALS IN DRAWINGS 10 fairway 1, 3, 5, 7, 9
12 fairway 2, 4, 6, 8,
14 rough throughout the course
16 first tee
18 second tee 2 20 third tee 3
22 fourth tee 4 24 fifth tee 5
26 sixth tee 6 28 seventh tee 7
30 eighth tee 8 32 nineth tee 9
34 two point dark green for holes 1, 3, 5, 7, 9,
36 two point dark green for holes 2, 4, 6, 8,
38 Mazer-Target for holes 1, 3, 5, 7, 9,
40 target area for holes 2, 4, 6, 8,
42 red three point ring of target area for holes 1, 3, 5, 7, 9,
44 red three point ring of target area for holes 2, 4, 6, 8,
46 white four point ring of target area for holes 1, 3, 5, 7, 9,
48 white four point ring of target area for holes 2, 4, 6, 8,
50 blue five point ring of target area for holes 1, 3, 5, 7, 9,
52 blue five point ring of target area for holes 2, 4, 6, 8,
54 orange six point circular shaped center of target area for holes 1, 3, 5, 7, 9,
56 orange six point egg shaped center of target area for holes 2, 4, 6, 8,
58 light green one point zone for holes 1, 3, 5, 7, 9,
60 light green one point zone for holes 2, 4, 6, 8,
62 66, 68, 70, 72, 74, 76, 78 yellow negative one point sand traps
64 one long continuous blue negative two point water hazard
80,80' golf club
82,82' golf ball
96 cut level loop carpet material
A,B players
R runner.

I claim:

1. A golf game device comprising a substantially flat, elongated runner formed of a carpet material for use with a golf ball and putter and having depicted on a surface thereof simulations of a golf course and comprising rough, fairway, green, and hazard areas over which a golf ball may be putted for simulating play on a real golf course, a pair of relatively laterally and longitudinally displaced target areas each including a generally concentric array of different scoring zones located proximate a different one of the ends and sides and within the boundaries of the flat runner and a plurality of differently designated discrete play positions differentially longitudinally and laterally displaced from and arrayed to indicate play in alternating and generally opposite directions between the target areas on the runner, said hazard and target areas bearing designations of different scoring point values used in the game to arrive at an individual player's total competitive performance score for the total number of play positions designated on the runner.

2. A device in accordance with claim 1 wherein at least one of the hazard areas on the runner divides the runner into two generally longitudinally extending playing fields each differently configured with differently located and irregularly shaped hazard areas and presenting somewhat different and varied visual aspects of play between the target areas on the runner from the various playing positions thereon.

3. A device in accordance with claim 2 wherein the two playing fields are of different widths or lateral dimensions at at least one end of the runner.

4. A device in accordance with claim 3 accommodating play for two players commencing in opposite directions from opposite ends of the runner.

5. A device in accordance with claim 4 accommodating substantially simultaneous play for the two players.

6. A device in accordance with claim 2 wherein said at least one hazard area is depicted as a water hazard.

7. A device in accordance with claim 2 wherein the said playing positions are variously differently located on the runner for play commencing from a first play position on a first one of the playing fields to the target area on that field, then to a second play position on the second playing field back to the target area on that second playing field, and then to a third playing position located at a still different position on the said first one of the playing fields and back to its associated target area, whereby play continues in an alternating and oppositely directed manner at different longitudinal and angular distances relative to and between the opposite target areas until completion of play from a designated number of playing positions on the runner.

8. A device in accordance with claim 1 wherein each of said target areas on the flat runner comprises a plurality of concentric rings of increasing radial distance from and surrounding a centrally located imperforate area representing a cup.

9. A device in accordance with claim 8 wherein the hazard and target areas are designated and defined by different shapes, colors and scoring point values on the runner.

10. A device in accordance with claim 9 wherein the areas between adjacent ones of said concentric target rings additionally have designations such as and selected from the group consisting of "Eagle", "Birdie", "Par", "Bogey" and "Double Bogey" thereon depending on the radial distance from the center of their circumscribed associated target area.

11. A device in accordance with claim 8 wherein said centrally located area of at least one of the target areas is of an elongated egg-shape.

12. A device in accordance with claim 1 wherein said carpet material is a cut pile fibre and the playing fields are applied with differently colored and permanently set dyes to at least one surface of the runner.

* * * * *